United States Patent [19]

Hall

[11] 4,363,487

[45] Dec. 14, 1982

[54] GAME TOP

[75] Inventor: Henry H. Hall, Racine, Wis.

[73] Assignee: Mattel, Inc., Hawthorne, Calif.

[21] Appl. No.: 187,109

[22] Filed: Sep. 15, 1980

[51] Int. Cl.[3] ..... A63F 5/04

[52] U.S. Cl. ..... 273/147; 46/65

[58] Field of Search ..... 273/147; 46/64, 65, 46/73, 49; D21/41, 95

[56] References Cited

U.S. PATENT DOCUMENTS

| | | | |
|---|---|---|---|
| 21,753 | 8/1892 | Huntoon | 273/147 X |
| D. 197,564 | 2/1964 | Ruderian | D21/41 |
| D. 232,114 | 7/1974 | Echterling | D21/95 |
| 1,139,119 | 5/1915 | Heidenreich | 46/64 |
| 1,262,061 | 4/1918 | Kristofek | 46/64 |
| 1,267,558 | 5/1918 | Komorous | 46/64 |
| 1,321,589 | 11/1919 | Behringer | 273/147 |
| 1,543,616 | 6/1925 | Pfeiffer, Sr. | D21/41 X |
| 1,578,632 | 3/1926 | Bommer | 273/147 X |
| 2,282,314 | 5/1942 | Houlihan | 46/64 |
| 2,879,066 | 3/1959 | Sutherland | 273/147 |
| 3,136,550 | 6/1964 | Ruderian | 273/147 X |
| 3,143,347 | 8/1964 | Ruderian | 273/147 |
| 3,813,810 | 6/1974 | Majewski | 46/73 X |

FOREIGN PATENT DOCUMENTS

| | | | |
|---|---|---|---|
| 429903 | 2/1948 | Italy | 273/147 |
| 463618 | 5/1951 | Italy | 273/147 |
| 184750 | 8/1922 | United Kingdom | 273/147 |
| 803600 | 10/1958 | United Kingdom | 273/147 |

*Primary Examiner*—Richard C. Pinkham
*Assistant Examiner*—Arnold W. Kramer
*Attorney, Agent, or Firm*—Ronald M. Goldman; Max E. Shirk; James G. O'Neill

[57] ABSTRACT

A plate of polygonal shape having indicia printed on at least one side thereof is trapped between transparent hemispherical domes each having a spindle extending therefrom.

3 Claims, 3 Drawing Figures

GAME TOP

BACKGROUND OF THE INVENTION

The background of the invention will be set forth in two parts.

FIELD OF THE INVENTION

The present invention pertains generally to the field of tops and more particularly to a new and useful game top.

DESCRIPTION OF THE PRIOR ART

The prior art presently known to applicant has been made of record in separate communications to the U.S. Patent and Trademark Office.

The present invention exemplifies improvements in tops of the type shown in this prior art.

OBJECTS AND SUMMARY OF THE INVENTION

It is a primary object of the present invention to provide a new and useful game top.

It is another object of the present invention to provide a game top of the type described which may be manufactured economically and expeditiously.

According to the present invention, a game top is provided which includes a polygonal plate having an upper surface and a lower surface, game indicia printed on at least one of the surfaces, a first transparent, unitary hemispherical dome and spindle assembly afixed to the upper surface of the plate in overlying relationship therewith with the spindle extending upwardly from the dome and having a major axis passing through the center of the dome and the plate and a second transparent unitary hemispherical dome and spindle assembly afixed to the lower surface of the plate in overlying relationship therewith and with the spindle depending from the dome and having a major axis passing through the center of the dome and the plate.

The plate may be hexigonal and may be die cut from a sheet of cardboard. The six sides of the plate may be identified by suitable numerals such as 0, 5, 10, 15, 20 and 25, respectively. Suitable instructions for playing a game may also be printed on the plate. For example, the instructions might state, "Spin five times; add your score; high score wins".

The other side of the plate may also be printed with suitable indicia. For example, the six sides of the polygon may be provided with the words, "Out", "Home run", "Single", "Out", "Triple" and "Double", respectively. Suitable instructions may also be printed on this side of the plate. For example the instructions might state, "Rules of Baseball apply"; "High score wins"; "Play three to nine innings"; "Take turns spinning"; "Spin until three outs".

Both sides or surfaces of the plate may be coated with a suitable hot-melt adhesive to form a blister seal covering.

The hemispherical dome and spindle assemblies may be identical and each may be made by vacuum forming techniques using clear, blister-pack pieces made from a suitable polymeric material such as 0.015" polyvinylchloride. Each spindle may be formed with splines to facilitate gripping the spindle and spinning the top. Each dome and spindle assembly may be heat sealed to its associated side of the plate.

The features of the present invention which are believed to be novel are set forth with particularity in the appended claims. The present invention, both as to its organization and manner of use, together with further objects and advantages thereof, may be best understood by reference to the following description, taken in connection with the accompanying drawing in which like reference characters refer to like elements in the several views.

DESCRIPTION OF THE PREFERRED EMBODIMENT

Figure 3:
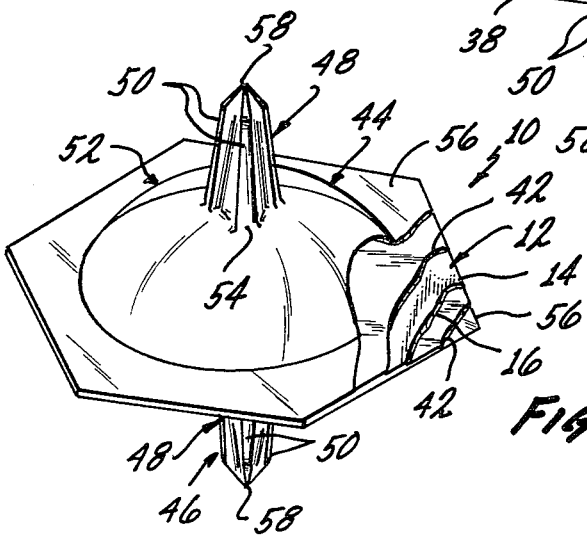
FIG. 3 is a perspective view of the top of FIG. 1 with parts broken away to show internal construction.

Referring again to the drawing, a game top constituting a presently-preferred embodiment of the invention, generally designated 10, includes a plate 12 having an upper surface 14 (FIG. 3) and a lower surface 16 (FIG. 3). Plate 12 may have a suitable polygonal shape and is shown herein for purposes of illustration, but not of limitation, as having an hexagonal shape. Plate 12 may be die cut from a suitable sheet of cardboard, such as 12 point C2S, SBB Stock.

Game indicia may be printed on at least one surface of plate 12. For example, the numerals 0, 15, 5, 25, 10, and 20 (FIG. 1) may be printed on upper surface 14 adjacent sides 18, 20, 22, 24, 26 and 28 of plate 12, respectively. Suitable instructions may also be printed on a surface 14 adjacent the edges thereof. The instructions, "Spin five times"; "Add your score"; "High score wins" may be printed adjacent edges 26, 18 and 20, respectively, as shown herein for purposes of illustration but not of limitation.

Figure 2:
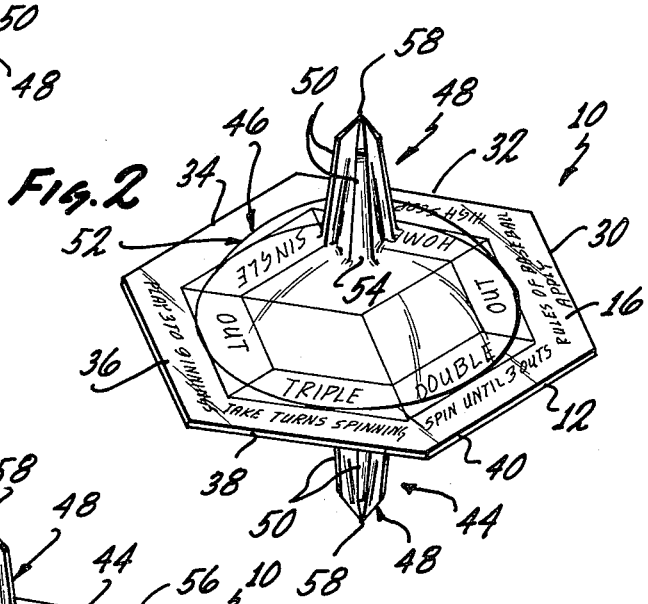
FIG. 2 is a perspective view of the top of FIG. 1 with its underside uppermost.

As shown in FIG. 2, game indicia may also be printed on the lower surface 16. These indicia are shown herein for purposes of illustration but not of limitation as comprising things associated with a baseball game. For example, the words, "Out", "Home run", "Single", "Out", "Triple" and "Double" may be printed on surface 16 adjacent edges 30, 32, 34, 36, 38 and 40, respectively. Additionally, suitable game instructions like, "Play three to nine innings"; "Take turns spinning"; "Spin until three outs"; "Rules of baseball apply" and "High score wins" may be printed adjacent edges 36, 38, 40, 30 and 32, respectively.

The surfaces 14, 16 of plate 12 may be coated with a suitable hot-melt adhesive to form a blister seal covering 42 (FIG. 3).

Game top 10 also includes first and second transparent, unitary hemispherical dome and spindle assemblies 44, 46 affixed to upper surface 14 and lower surface 16, respectively. Each assembly includes a hollow spindle 48 provided with a plurality of splines 50 forming a gripping surface to facilitate spinning top 10. Each assembly also includes a hemispherical dome 52 having a crown 54 which carries spindle 48 and a lower edge which is encompassed by an annular flange 56 (FIG. 3). The assemblies 44, 46 may each be fabricated from a suitable sheet of 0.015" polyvinylchloride employing vacuum-forming techniques. Assembly 44 may then be affixed to upper surface 14 by heat sealing annular flange 56 to coating 42 on surface 14 and assembly 46 may be affixed to lower surface 16 by heat sealing the annular flange 56 on assembly 46 to the covering on surface 16.

Each spindle 48 is provided with a pointed tip 58 forming a suitable spinning surface for top 10. The major axes of spindles 48 are aligned and passed through the center of plate 12.

The manner of using game top 10 is believed to be apparent from the foregoing and will be briefly described at this point.

Figure 1:
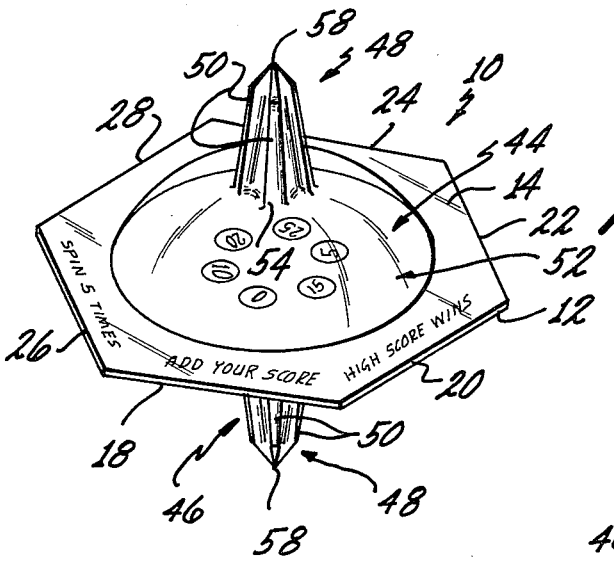
FIG. 1 is a perspective view of a game top constituting a presently-preferred embodiment of the invention.

Referring to FIG. 1, a first game may be played with game top 10 by positioning tip 58 of assembly 46 on a suitable surface, grasping spindle 48 on upper assembly 44 and spinning top 10, which, after a short time, will topple over on one of the edges 18–28. The numeral adjacent the edge on which the top rests will be recorded as the score for that particular spin. If more than one player participates, each player will take turns spinning top 10 until each have spun it five times. These players' scores will then be added up and the player with the highest score will be declared the winner.

Referring now to FIG. 2, tip 58 of assembly 44 may be placed on a suitable surface and top 10 may be spun by grasping spindle 48 on assembly 46. When top 10 comes to rest on one of the edges 30–40 an indication will be given as to the nature of the play made by the player spinning top 10. Either two players or two teams having a plurality of players on each team may take turns spinning top 10. The player or team having a particular turn keeps spinning until three outs are made. Three to nine innings may be played following the rules of baseball. The player or team having the highest score at the end of the number of innings decided upon as constituting a game will be declared the winner.

While the particular game top herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims, which form a part of this disclosure.

What is claimed is:

1. A game top comprising:

a polygonal shaped plate having an upper surface and a lower surface;

game indicia printed on at least one of said surfaces;

first and second transparent, unitary hemispherical dome and spindle assemblies fixed to said upper and lower surfaces of said plate along a lower edge of said domes;

each of said dome and spindle assemblies comprising a hollow hemispherical dome having a crown which carries a spindle, said spindles being hollow and having a plurality of spines and a pointed tip; and an annular flange encompassing said lower edge of each of said domes, said flanges being heat sealed to said surfaces of said plate.

2. The game top of claim 1 wherein said plate is made from cardboard, said upper and lower surfaces of said plate being coated with a blister seal coating, and said first and second assemblies are heat sealed to said coating on each side of said plate by said flanges.

3. The game toy of claim 2 wherein said plate has an hexagonal shape.

* * * * *

UNITED STATES PATENT AND TRADEMARK OFFICE

CERTIFICATE OF CORRECTION

PATENT NO. : 4,363,487

DATED : December 14, 1982

INVENTOR(S) : Henry H. Hall

It is certified that error appears in the above-identified patent and that said Letters Patent is hereby corrected as shown below:

On the title page assignee should read

-- (73) Assignee: Western Publishing Company, Inc., Racine, Wis. --.

Signed and Sealed this

Sixth Day of December 1983

[SEAL]

*Attest:*

GERALD J. MOSSINGHOFF

*Attesting Officer*

*Commissioner of Patents and Trademarks*